US007935470B2

(12) United States Patent
Jeong et al.

(10) Patent No.: US 7,935,470 B2
(45) Date of Patent: May 3, 2011

(54) TONER FOR ELECTROPHOTOGRAPHY

(75) Inventors: Jae-hyeuk Jeong, Suwon-si (KR); Kyung-yol Yon, Seongnam-si (KR); Min-young Cheong, Seoul (KR); Kyeong Pang, Suwon-si (KR); Yo-da Shin, Incheon Metropolitan (KR); Hae-ree Joo, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 845 days.

(21) Appl. No.: 11/979,775

(22) Filed: Nov. 8, 2007

(65) Prior Publication Data

US 2008/0182195 A1 Jul. 31, 2008

(30) Foreign Application Priority Data

Jan. 30, 2007 (KR) ..... 10-2007-0009530

(51) Int. Cl.
*G03G 9/00* (2006.01)

(52) U.S. Cl. ..... 430/111.4; 430/123.5; 430/123.53; 430/123.54; 399/252

(58) Field of Classification Search ..... 430/111.4, 430/123.5, 123.53, 123.54; 399/252
See application file for complete search history.

(56) References Cited

U.S. PATENT DOCUMENTS 6,497,983 B2 * 12/2002 Iwa et al. ..... 430/109.2
6,682,867 B2 * 1/2004 Kubo et al. ..... 430/109.2
7,001,701 B2 * 2/2006 Fujii et al. ..... 430/108.4

* cited by examiner

*Primary Examiner* — Mark A Chapman
(74) *Attorney, Agent, or Firm* — Roylance, Abrams, Berdo & Goodman, L.L.P.

(57) ABSTRACT

A toner for electrophotography is provided including a binder resin, a colorant, a charge control agent, and a release agent, wherein a glass transition temperature (Tg) is over 55° C., a molecular weight distribution (MWD) is in the range of about 4.5 to 5.5 when a weight average molecular weight is in the range of about 45,000 to 55,000, and a compression elastic modulus is about 750 MPa or higher at room temperature. Mechanical properties of toner can be obtained at room temperature by controlling rheological properties of toner. The developing properties and fixing properties of toner for electrophotography can be improved by lowering viscosity at a high temperature, and thus image quality can be stabilized.

7 Claims, 2 Drawing Sheets

TONER FOR ELECTROPHOTOGRAPHY

CROSS-REFERENCE TO RELATED PATENT APPLICATION

This application claims the benefit of Korean Patent Application No. 10-2007-0009530, filed on Jan. 30, 2007, in the Korean Intellectual Property Office, the disclosure of which is hereby incorporated by reference in its entirety.

BACKGROUND OF THE INVENTION

1. Field of the Invention

The present invention relates to toner for electrophotography. More particularly, the invention relates to toner for electrophotography having an improved developing property and fixing property using rheological property.

2. Description of the Related Art

In image forming devices such as electrophotographic devices or electrostatic recording devices, an electrostatic latent image is formed through light-exposure on a photoreceptor which is uniformly charged. A toner is attached to the electrostatic latent image, and a resulting toner image is transferred to a transfer medium such as a sheet of paper. Then, an unfixed toner image is fixed on the transfer medium through several processes such as heating, pressing, solvent steaming, and so on. In most fixing processes, the transfer medium with the toner image passes through fixing rollers and pressing rollers, and by heating and pressing, the toner image is fused on the transfer medium. Toner is fixed on the transfer medium according to fixing conditions to form a stable image.

In developing processes, toner particles are transferred to a photoreceptor and selectively attached to a latent image by an electrostatic force to form a toner image on the photoreceptor. However, when the toner does not have sufficient mechanical properties, problems such as streak and blocking may occur during the developing process.

Meanwhile, if only the mechanical property is improved to facilitate the developing process, fixing property of toner may decrease. In the fixing process, the surface of a roller contacts the toner image in the melt state under pressure. Thus, toner may partially be transferred and attached to the surface of the fixing roller and transferred to a subsequent fixing sheet, thereby contaminating the subsequent fixing sheet.

Toner for electrophotography having a specific rheological property disclosed in Korean Patent No. 138,583, Korean Patent Publication Nos. 2001-083034, and 1999-063467. However, they fail to obtain both of superior developing property and fixing property. Thus, there is need for a technology that can predict the behavior of a toner to improve the developing property and the fixing property and stabilize the image quality.

SUMMARY OF THE INVENTION

The present invention provides a toner for electrophotography having an improved developing property and a fixing property by controlling its rheological property. The invention is also directed to a toner for providing stabilized image quality.

The present invention also provides a method and apparatus for forming an image using the toner.

According to an aspect of the present invention, a toner is provided for electrophotography including a binder resin, a colorant, a charge control agent, and a release agent, wherein the toner has a glass transition temperature (Tg) of over 55° C., a molecular weight distribution (MWD) is in the range of about 4.5 to 5.5 when a weight average molecular weight is in the range of about 45,000 to 55,000, and a compression elastic modulus of about 750 MPa or higher at room temperature.

According to another aspect of the present invention, a method of forming an image is provided including: forming a visual image by attaching a toner to a surface of a photoreceptor on which an electrostatic latent image is formed; and transferring the visible image to a transfer medium, wherein the toner is a toner for electrophotography including a binder resin, a colorant, a charge control agent, and a release agent, wherein the toner has a glass transition temperature (Tg) of over 55° C., a molecular weight distribution (MWD) of in the range of about 4.5 to 5.5 when a weight average molecular weight is in the range of about 45,000 to 55,000, and a compression elastic modulus of about 750 MPa or higher at room temperature.

According to another aspect of the present invention, an apparatus for forming an image is provided including: an organic photoreceptor; a unit for charging a surface of the organic photoreceptor; a unit for forming an electrostatic latent image on a surface of the organic photoreceptor; a unit for containing a toner; a unit for supplying the toner to the surface of the organic photoreceptor to develop the electrostatic latent image on the surface of the organic photoreceptor into a toner image; and a unit for transferring the toner image from the surface of the organic photoreceptor onto a transfer medium, wherein the toner is a toner for electrophotography including a binder resin, a colorant, a charge control agent, and a release agent, wherein a glass transition temperature (Tg) is over 55° C., a molecular weight distribution (MWD) is in the range of about 4.5 to 5.5 when a weight average molecular weight is in the range of about 45,000 to 55,000, and a compression elastic modulus is 750 MPa or higher at room temperature.

These and other aspects of the invention will become apparent from the following detailed description of the invention which when taken in conjunction with the drawings disclose various embodiments of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
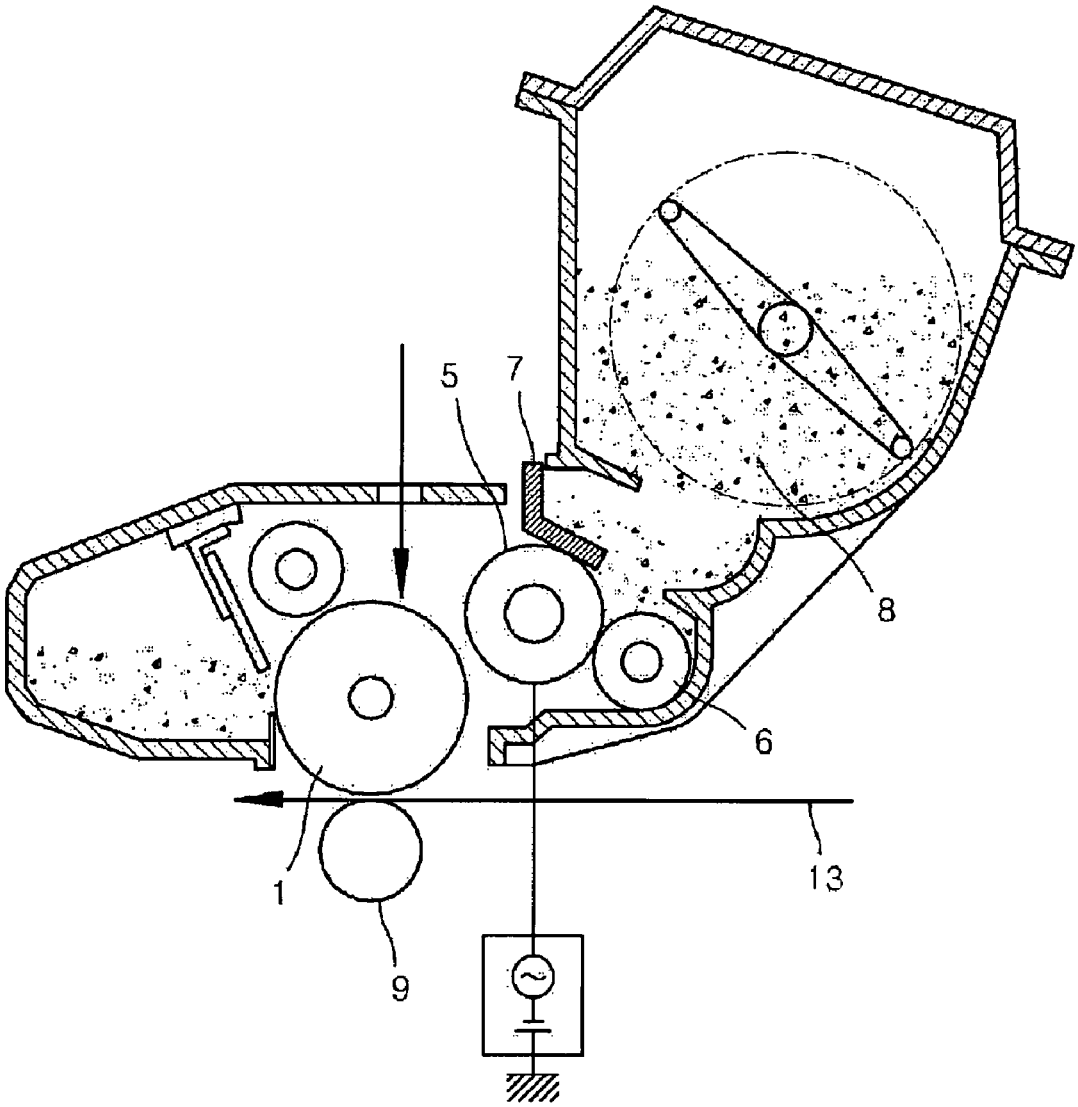
FIG. 1 illustrates an image forming apparatus including a toner prepared according to an embodiment of the present invention.

Hereinafter, the present invention will now be described more fully with reference to the accompanying drawings, in which exemplary embodiments of the invention are shown. The invention may, however, be embodied in many different forms and should not be construed as being limited to the embodiments set forth herein. Rather, these embodiments are provided so that this disclosure will be thorough and complete, and will fully convey the concept of the invention to those skilled in the art.

Toner for electrophotography according to an embodiment of the present invention includes a binder resin, a colorant, a charge control agent, and a release agent. A glass transition temperature (Tg) of the toner is over 55° C., a molecular weight distribution (MWD) is in the range of about 4.5 to 5.5 when a weight average molecular weight is in the range of about 45,000 to 55,000, and a compression elastic modulus is about 750 MPa or higher at room temperature. When the MWD is 6.5 or higher, the toner has a tendency of contamination at high temperature. As MWD increases, the processes cannot be easily controlled and image cannot be easily formed. On the other hand, when the MWD is less than 4.5, the processes take a longer time, and the yield may be reduced. Thus, a desirable MWD is in the range of about 4.5 to 5.5.

When the molecular weight is too large or the MWD is too narrow, the fixing property may decrease due to reduction in cohesion among toner particles in spite of an increase in the mechanical property. On the other hand, when the molecular weight is too small or the MWD is too wide, frictional force or contamination may occur due to the poor mechanical property of the toner.

When the MWD is less than 4.5, the processes take a longer time, and the yield may be reduced, and when the MWD is 5.5 or higher, the toner has a tendency of contamination at high temperature. The compression elastic modulus may be 750 MPa or higher, and preferably between 750 and 2,500 MPa. When the compression elastic modulus is less than 750 MPa, deformation due to frictional stress may occur in the developing unit since hardness is low at room temperature.

Compression hardness indicates a mechanical property by which the toner is not deformed in friction in the developing unit during the developing process and the toner stably behaves. When the compression hardness is too low, the toner may have a tendency to deform by an external force. On the other hand, when the compression hardness is too high, the toner may have a poor fixing property due to its poor property at a high temperature in spite of the high stability in the formation.

A complex viscosity ($\eta$) of toner may be in the range of $3.5\times10^2$ to $4.5\times10^2$ Pa·s at a temperature of 10° C. lower than a toner fixing temperature. The fixing temperature is typically about 160° C. to 200° C. When the complex viscosity ($\eta$) is less than 350 Pa·s, a cohesion of the binder resin is significantly reduced to cause offset in a high temperature range. When the complex viscosity ($\eta$) is 450 Pa·s or higher, a cohesion of the binder resin is too high to obtain the surface gloss and proper fixing strength of a fixed image.

An angular velocity of a fixing unit may be in the range of 5 to 10 rad/s when measuring the complex viscosity. A dynamic viscoelasticity may be determined using a temperature dispersion measurement by sinusoidal vibration in a frequency range of about 5 to 10 rad/s through an ARES apparatus manufactured by Rheometric Scientific.

A loss elastic modulus (G") may be in the range of about $1.5\times10^3$ to $2.5\times10^3$ Pa. When the loss elastic modulus is less than $1.5\times10^3$ Pa, the fixing temperature cannot be easily adjusted. When the loss elastic modulus is $2.5\times10^3$ Pa or higher, the preferred fixing properties cannot be easily obtained.

A stress relaxation means a force required for maintaining a reduction in strain with respect to time when a certain strain is applied to a toner. It represents a variation in elastic modulus with respect to time in which a toner stays on a fixing unit.

Herein, the stress relaxation is determined to confirm a time-dependency of viscoelasticity with respect to a fixing condition even when a toner has a desired viscosity. This is because the fixing condition does not depend only on the viscosity determined when a toner shows a stable viscoelastic behavior after a certain time but also on a viscoelasticity for a very short time before stabilization.

A specified activation energy is a numerical value representing a viscosity variation with respect to a varied temperature. A toner having appropriate properties can be designed through the specified activation energy. According to an embodiment of the present invention, when the specified activation energy is less than 20 KJ/mol, the sensitivity of the viscosity variation with respect to varied temperature is too low. Thus, a toner having a low viscosity has poor powder strength and a toner having a high viscosity attains a fixing strength or has physical properties which are difficult to deal with. When the specified activation energy is 80 KJ/mol or higher, the sensitivity of viscosity variation with respect to varied temperature is high, and thus, a toner has a preferred powder/liquid behavior, but does not have a desired viscosity with respect to temperature and other rheological properties.

According to an embodiment of the present invention, even when a toner has a desired viscosity, the stress relaxation may be about 3,500 to 4,500 Pa·s at a temperature of 10° C. lower than a toner fixing temperature for a dwell time. When the stress relaxation is less than 3,500 Pa·s, a cohesion of a liquid toner is low, resulting in contamination. When the stress relaxation is 4,500 Pa·s or higher, it is not preferable due to relatively strong elastic force.

A loss tangent, tan $\delta$ representing a ratio of a loss elastic modulus G"/a storage elastic modulus G' of a toner may be less than 1 at a temperature of 20° C. lower than the fixing temperature. The storage elastic modulus G' is related to the elasticity of a toner and the loss elastic modulus G" is related to the plasticity of a toner. Thus, when the storage elastic modulus increases, the elasticity of a toner increases. When the loss elastic modulus increases, the plasticity of a toner increases. To maintain sufficient gloss of a fixed image, it is important to adjust a ratio of elasticity to plasticity while maintaining a desired elasticity. When tan $\delta$ is 1 or greater at a temperature of 20° C. lower than the fixing temperature, the elasticity of a toner is deteriorated, resulting in contamination or wrap jam.

Compressional strain ($\Delta L/L_0$) of the toner indicates a powder behavior within a linear differential section according to compression (variation) with respect to a ratio of a reduced diameter ($\Delta L$) to a diameter before compression ($L_0$). A critical compressional strain of the toner for electrophotography may be at least 0.2, and preferably in the range of about 0.3 to 0.5. When the critical compressional strain is greater than the critical value, powder saturation strain is flexible and thus the toner tends to be not easily broken by an external force. When the compressional strain is less than the critical value, the toner is too brittle regardless of an elastic modulus, and thus, it tends to be easily broken by an external force.

When a toner has a low elasticity and a high plasticity, the releasing property of the toner from rollers by elasticity is poor, resulting in contamination, or the viscosity of the toner itself is reduced to cause unbalanced adhesion between sheets of paper, strength of the toner itself, and the adhesion to H/R.

The toner forms an image through charging, exposing, developing, transferring, fixing, cleaning and erasing processes. The range of desired physical properties of a toner may be determined in the developing process before the fixing process.

A binder resin used in the toner for development according to an embodiment of the present invention may be various resins known in the art. For example, suitable binder resins include styrene-based copolymers such as polystyrene, polyp-chlorostyrene, poly-α-methylstyrene, styrene-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-acrylonitrile-indene copolymer, styrene-maleic acid copolymer, styrene-maleic ester copolymer; and polymethyl methacrylate, polyethyl methacrylate, polybutyl methacrylate, and copolymers thereof, polyvinyl chloride, polyvinyl acetate, polyethylene, polyepropylene, polyester, polyurethane, polyamide, epoxy resin, polyvinyl butyral resin, rosin, modified rosin, terpene resin, phenol resin, aliphatic or alicyclic hydrocarbon resin, aromatic petroleum resin, chlorinated paraffin, paraffin wax, and the like. These resins may be used alone or in combination. Polyester-based resins are suitable for a color developing agent due to the good fixing property and clearness.

A colorant may be carbon black or aniline black for a black toner. A non-magnetic toner according to an embodiment of the present invention is suitable for a color toner. Carbon black is generally used as a black colorant. To make colors, yellow colorant, magenta colorant, and cyan colorant may further be included.

For the yellow colorant, a condensation nitrogen compound, an isoindolinone compound, anthraquinone compound, an azo metal complex, or an allyl imide compound can be used. For example, C.I. pigment yellow 12, 13, 14, 17, 62, 74, 83, 93, 94, 95, 109, 110, 111, 128, 129, 147, 168, 180, and the like can be used.

For the magenta colorant, a condensation nitrogen compound, an anthraquinone, quinacridone compound, base dye lake compound, naphthol compound, benzo imidazole compound, thioindigo compound, or perylene compound can be used. For example, C.I. pigment red 2, 3, 5, 6, 7, 23, 48:2, 48:3, 48:4, 57:1, 81:1, 122, 144, 146, 166, 169, 177, 184, 185, 202, 206, 220, 221, or 254, and the like can be used.

For the cyan pigment, copper phthlaocyanine compound and derivatives thereof, anthraquinone compound, or base dye lake compound can be used. For example, C.I. pigment blue 1, 7, 15, 15:1, 15:2, 15:3, 15:4, 60, 62, or 66, and the like can be used.

Such colorants can be used alone or in a combination of two or more colorants, and are selected in consideration of color, chroma, luminance, resistance to weather, dispersion property in toner, and the like.

The amount of the colorants may be in the range of about 0.1 to 20 parts by weight based on 100 parts by weight of the binder resin. The amount of the colorants may be any amount that sufficiently colors the toner. When the amount of the colorant is less than 0.1 parts by weight, the coloring effect of the colorant is insufficient. When the amount of the colorant is 20 parts by weight or greater, cost for preparing toner is increased, and the sufficient amount of friction charging can not be obtained.

Examples of a chain transfer agent may include, but are not restricted to: sulfur-containing compounds such as dodecanethiol, thioglycolic acid, thioacetic acid and mercaptoethanol; phosphorous acid compounds such as phosphorous acid and sodium phosphorate; hypophosphorous acid compounds such as hypophosphorous acid and sodium hypophosphorate; and alcohols such as methyl alcohol, ethyl alcohol, isopropyl alcohol and n-butyl alcohol.

Examples of a polymerization initiator may include persulfates such as potassium persulfate and ammonium persulfate; azo compounds such as 4,4-azobis(4-cyanovaleric acid), dimethyl-2,2'-azobis(2-methylpropionate), 2,2-azobis(2-amidinopropane) dihydrochloride, 2,2-azobis-2-methyl-N-1,1-bis(hydroxymethyl)-2-hydroxyethylpropioamide, 2,2'-azobis(2,4-dimethylvaleronitrile), 2,2'-azobisisobutyronitrile, and 1,1'-azobis(1-cyclohexanecarbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropylperoxy dicarbonate, and di-t-butyl peroxy isophthalate. An oxidation-reduction initiator, which is a combination of the polymerization initiator and a reducing agent, may also be used.

The release agent can be used to protect a photoreceptor and prevent deterioration of developing, thereby obtaining a high quality image. A release agent according to an embodiment of the present invention may be a high purity solid fatty acid ester material. Examples of the release agent may include low molecular weight polyolefins such as low molecular weight polyethylene, low molecular weight polypropylene, low molecular weight polybutylenes, and the like; paraffin wax; multi-functional ester compound, and the like. The release agent may be a multifunctional ester compound composed of alcohol having at least three functional groups and carboxylic acid.

A charge control agent may be preferably selected from the group consisting of a salicylic acid compound containing metals such as zinc, aluminum, boron complexes of bis diphenyl glycolic acid, and silicate. More preferably, dialkyl salicylic acid boron, boro bis (1,1-diphenyl-1-oxo-acetyl potassium salt), or the like can be used.

A wax contained in the toner may be appropriately selected according to the purpose of the final toner. Examples of the wax that can be used may include polyethylene-based wax, polypropylene-based wax, silicone wax, paraffin-based wax, ester-based wax, carbuna wax and metallocene wax, but are not limited thereto. The wax used in the toner may particularly have a melting point in the range of about 50 to 150° C. Components of the wax physically adhere to toner particles, but may not covalently bind with the toner particles. The wax is fixed on a final image receptor at a low temperature, and the toner having excellent durability of final images and excellent rubfastness is obtained.

The present invention also provides a method of forming an image including: forming a visual image by attaching a toner to a surface of a photoreceptor on which an electrostatic latent image is formed; and transferring the visible image to a transfer medium, wherein the toner is a toner for electrophotography including a binder resin, a colorant, a charge control agent, and a release agent, wherein a glass transition temperature (Tg) is over 55° C., a molecular weight distribution (MWD) is in the range of about 4.5 to 5.5 when a weight average molecular weight is in the range of about 45,000 to 55,000, and a compression elastic modulus is about 750 MPa or higher at room temperature.

A typical electrophotographic image forming process includes a series of processes of forming an image on a receptor, including charging, exposing, developing, transferring, fixing, cleaning and erasing processes.

In a charging process, a photoreceptor is positively or negatively charged by corona or charging rollers. In an exposing process, an optical system, typically a laser scanner or diode array selectively discharges the surface of the charged photoreceptor in an imagewise manner to correspond to a desired image to be formed on the final image receptor, thereby forming a latent image. Electromagnetic radiation which is referred to as "light" may include, for example, infrared radiation, visible ray and ultraviolet radiation.

In a developing process, polar toner particles contact with the latent image on the photoreceptor in which a developing unit having the same potential polarity as a toner polarity, typically electrically-biased, is used. Toner particles are transferred to the photoreceptor and selectively attached to the latent image by electrostatic force to form a toner image on the photoreceptor.

In the transferring process, the toner image is transferred to a desired final image receptor from the photoreceptor. An intermediate transferring element is sometimes used to affect transferring of the toner image to a final image receptor from the photoreceptor with a subsequent transferring.

In a fixing process, the toner image on the final image receptor is heated to soften or melt toner particles, thereby the toner image can be fixed on the final receptor. Another fixing method includes fixing a toner on a final receptor under a high pressure with or without applying heat.

In a cleaning process, the remaining toner on the receptor is removed. Finally, in an erasing process, charges of the photoreceptor are reduced to a substantially uniformly low value by exposure to light of a specific wavelength band. Thus, residues of an original latent image are removed and a photoreceptor for the next image forming cycle is prepared.

The present invention also provides an apparatus for forming an image including an organic photoreceptor; a unit for charging a surface of the organic photoreceptor; a unit for forming an electrostatic latent image on a surface of the organic photoreceptor; a unit for containing a toner; a unit for supplying the toner to the surface of the organic photoreceptor to develop the electrostatic latent image on the surface of the organic photoreceptor into a toner image; and a unit for transferring the toner image from the surface of the organic photoreceptor onto a transfer medium, wherein the toner is a toner for electrophotography including a binder resin, a colorant, a charge control agent, and a release agent, wherein a glass transition temperature (Tg) is over 55° C., a molecular weight distribution (MWD) is in the range of 4.5 to 5.5 when a weight average molecular weight is in the range of about 45,000 to 55,000, and a compression elastic modulus is 750 MPa or higher at room temperature.

FIG. 1 illustrates a non-contact developing type image forming apparatus including toner prepared according to an embodiment of the present invention. The operating principles of the image forming apparatus are explained below.

A developer 8, as a non-magnetic one-component developer, is supplied to a developing roller 5 through a feeding roller 6 formed of an elastic material such as a polyurethane foam or sponge. The developer 8 supplied to the developing roller 5 reaches a contact point between the developing roller 5 and a developer regulation blade 7 as the developing roller 5 rotates. The developer regulation blade 7 is formed of an elastic material such as metal or rubber. When the developer 8 passes the contact point between the developing roller 5 and the developer regulation blade 7, the developer 8 is smoothed to form a thin layer that is sufficiently charged. The developing roller 5 transfers the thin layer of the developer 8 to a developing domain where the thin layer of the developer 8 is developed on the electrostatic latent image of a photoreceptor 1, which is a latent image carrier.

The developing roller 5 and the photoreceptor 1 face each other with a constant distance therebetween. The developing roller 5 rotates counterclockwise and the photoreceptor 1 rotates clockwise. The developer 8 transferred to the developing domain forms an electrostatic latent image on the photoreceptor 1 according to the intensity of an electric charge generated due to a difference between an AC voltage superposed with a DC voltage applied to the developing roller 5 and a latent image potential of the photoreceptor 1.

The developer 8 developed on the photoreceptor 1 reaches a transferring device 9 as the photoreceptor 1 rotates. The developer 8 developed on the photoreceptor 1 is transferred through corona discharging or by a roller to a printing paper 13 as the printing paper 13 passes between the photoreceptor 1 and the transferring device 9. The transferring device 9 receives a high voltage with an opposite polarity to the developer 8, and thus forms an image.

The image transferred to the printing paper 13 passes through a fixing device (not shown) that provides high temperature and high pressure, and the image is fixed to the printing paper 13 as the developer 8 is fused to the printing paper 13. Meanwhile, the developer 8 remaining on the developing roller 5 and which is not developed is transferred back to the feeding roller 6 contacting the developing roller 5. The above processes are repeated.

The present invention will be described in more detail with reference to the examples below, but is not limited thereto. The following examples are for illustrative purposes only and are not intended to limit the scope of the invention.

EXAMPLE

Example 1

Styrene, acrylate, and methacrylic acid were mixed in a weight ratio of 74:21:5 to prepare a toner having a weight average molecular weight of 50000 and MWD of about 3.5.

Example 2

Styrene, acrylate, and methacrylic acid were mixed in a weight ratio of 76:19:5 to prepare a toner having a weight average molecular weight of 48510 and MWD of about 3.19.

Example 3

Styrene, acrylate, and methacrylic acid were mixed in a weight ratio of 75:19:6 to prepare a toner having a weight average molecular weight of 49500 and MWD of about 4.9.

Example 4

Styrene, acrylate, and methacrylic acid were mixed in a weight ratio of 75:20:5 to prepare a toner having a weight average molecular weight of 45670 and MWD of about 5.5.

Comparative Example 1

Styrene, acrylate, and methacrylic acid were mixed in a weight ratio of 70:28:2 to prepare a toner having a weight average molecular weight of 38620 and MWD of about 4.1.

Comparative Example 2

Styrene, acrylate, and methacrylic acid were mixed in a weight ratio of 72:23:5 to prepare a toner having a weight average molecular weight of 47000 and MWD of about 4.4.

Conditions of Fixing Unit

In the use of a fixing unit, the Nip was 8.5 mm, the fixing temperature was 170° C., the linear velocity of the fixing unit was 170 mm/s (dwell time 0.075 seconds), the external diameter of a heat roller of the fixing unit was 32.5 mm, and the rotation angular velocity of the fixing unit was about 6 rad/s.

Complex Viscosity Test

Samples in a power state were directly tested to exactly determine the physical properties of toner by minimizing addition/removal of thermal hysteresis caused during preparing the samples. The viscosity was measured through an ARES manufactured by Rheometric Scientific. A dynamic type frequency sweep test was performed with 3% of the compression strain, 10 rad/s of the rotation angular velocity, and about 1 mm of gap size.

Stress Relaxation Test

The viscosity is a function of temperature and strain with respect to time, and contamination is affected by, in addition to viscosity, viscoelasticity. Fixing conditions are affected by a time transient phenomena. Thus, to define properties of a toner clearly in consideration of these factors described above, a change in an elastic module with respect to the toner dwell time, that is, a stress relaxation was measured.

Compression Elastic Modulus Test

Compression elastic modulus test was performed at room temperature at a loading speed of 2 mN/s using a particle hardness tester manufactured by Shimadzu Corporation. The compression elastic modulus test was performed to evaluate toner stability against stress in a developing unit and particularly powder behavior against deformation or strength of deformation, that is, to test breakage and deformation of toner.

Tg of a polymerized toner may be controlled by the ratio of styrene-acrylate. Tg increases as the ratio of styrene and methacrylic acid increases, Mw increases according to the polymerization time, and MWD decreases as the polymerization temperature is lowered. Toner was tested by varying these parameters, and physical properties of toner prepared according to Example 1 and Comparative Examples 1 and 2 are shown in Table 1 below.

TABLE 1

| | Example 1 | Comparative Example 1 | Comparative Example 2 |
|---|---|---|---|
| Tg | 58 | 51 | 55 |
| Mw | 45670 | 38620 | 47000 |
| Mn | 9290 | 9393 | 10500 |
| MWD | 4.9 | 4.1 | 4.4 |

Compression elastic modulus and complex viscosity of toners having physical properties shown in Table 1 prepared according to Example 1 and Comparative Examples 1 and 2 were measured, and the results are shown in Table 2 below.

TABLE 2

| | Compression elastic modulus at room temperature | Complex viscosity at 170° C., at 6 rad/s |
|---|---|---|
| Example 1 | 1076 Mpa | 410 Pa · s |
| Comparative Example 1 | 571 Mpa | 450 Pa · s |
| Comparative Example 2 | 460 Mpa | 403 Pa · s |

As shown in Table 1, the toner prepared according to Example 1 had a compression elastic modulus of 1076 MPa, thereby exhibiting excellent compression hardness and stable behavior. However, the toners prepared according to Comparative Examples 1 and 2 respectively had compression elastic modulus of 571 MPa and 460 MPa, thereby exhibiting low compression elastic modulus and unstable behavior.

Figure 2:
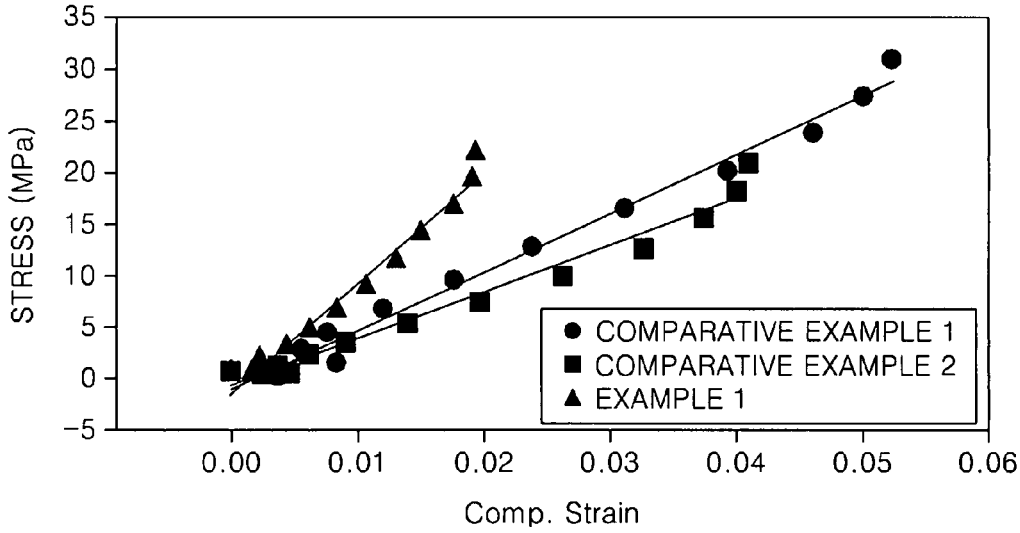
FIG. 2 is a graph illustrating compression behavior at room temperature of the toner prepared according to an embodiment of the present invention.

FIG. 2 is a graph illustrating compression behavior of samples at room temperature according to an embodiment of the present invention. Referring to FIG. 2, a compression elastic modulus is a ratio of compression stress to compression strain, that is, the inclination of the graph indicates the compression elastic modulus. Thus, an inclination over a predetermined level in the graph exhibits a stable behavior of toner. The inclination of Example 1 is greater than those of Comparative Examples 1 and 2, thereby having a greater compression elastic modulus and showing more stable behavior.

Samples were prepared for a fine adjustment of conditions of Example 1, and the compression elastic modulus was limited to 750 MPa or higher. The conditions are obtained from the tests to define properties related to stable compression hardness for developing. Properties defined in Examples 2 through 4 are shown in Table 3 below.

TABLE 3

| | Example 2 | Example 3 | Example 4 |
|---|---|---|---|
| Tg (° C.) | 59 | 60 | 58.5 |
| Mw | 53210 | 49500 | 45670 |
| Mn | 11567 | 10102 | 8303 |
| MWD | 4.6 | 4.9 | 5.5 |

TABLE 4

| | Complex viscosity (Pa · s) at 170° C. | Stress relaxation (Pa · s) at 0.05 | Loss elastic modulus (Pa) | Compression elastic modulus (MPa) | Critical compression strain |
|---|---|---|---|---|---|
| Example 2 | 430 | 3800 | 2100 | 1325 | 0.25 |
| Example 3 | 410 | 3664 | 1974 | 1150 | 0.27 |
| Example 4 | 385 | 3580 | 1853 | 856 | 0.21 |

As shown in Table 4, the prepared toner was stable in developing conditions. The fixing property of samples is as follows: Example 4>Example 3>Example 2. As illustrated in viscosity properties, as the samples behave more softly at a high temperature, their fixing properties improve. It is understood that this behavior is due to the influence of Mw and MWD and not due to the Tg.

In Examples 1 to 4, toners were prepared according to reaction conditions by fixing the amount of methacrylic acid and varying the ratio of styrene/acrylate. The effect of MWD was measured using a large monomer as an initiator. The effect of MWD was measured by fixing the weight average molecular weight (Mw). As a result, toner behaves more softly at a high temperature as the MWD increases.

However, when MWD is 6.5 or higher, the samples had a tendency to exhibit contamination at high temperature. As MWD increases, the processes cannot be easily controlled and the image cannot be easily formed. On the other hand, when the MWD is less than 4.5, the processes take a longer time, and the yield may be reduced. Thus, a desirable MWD is in the range of 4.5 to 5.5.

When the weight average molecular weight ranged from 45,000 to 55,000, a compression elastic modulus at room temperature and a viscosity behavior were stable and developing properties/fixing properties were also stable. When the compression hardness is 2,500 MPa or greater, a fixing process performed poorly (ex. fixing unit) due to poor properties (ex. high viscosity) at a high temperature.

The critical compression strain of the toner must be at least 0.2, but when the critical compression strain is less than 0.2, the toner is too brittle and breakable regardless of the elastic modulus.

Figure 3:
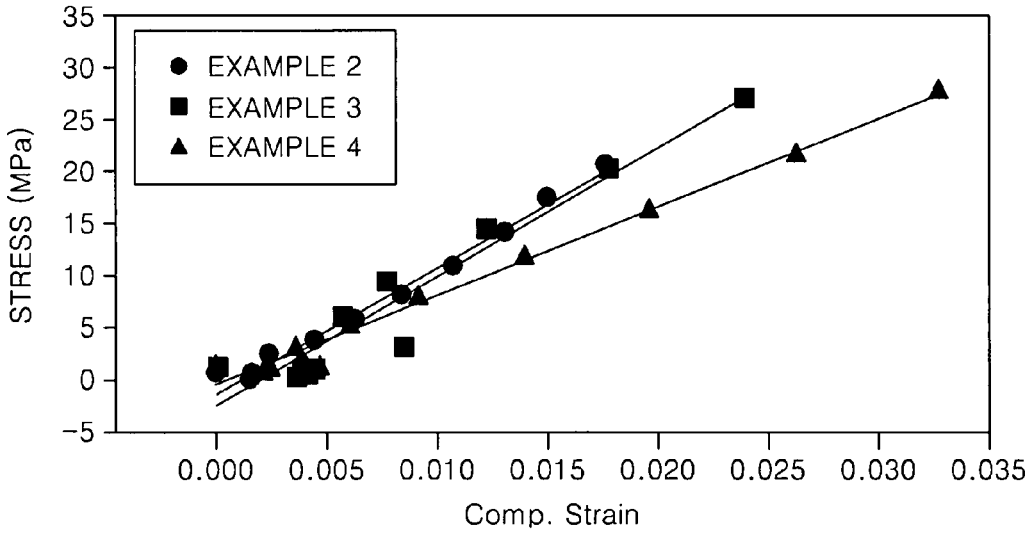
FIG. 3 is a graph illustrating compression behavior at room temperature of the toner prepared according to an embodiment of the present invention.

FIG. 3 is a graph illustrating the compression behavior at room temperature of the toner prepared according to an embodiment of the present invention. Referring to FIG. 3, the compression stress to compression strain, that is, the inclination of the graph was at least 750 MPa, and the critical compression strain was 0.2 or higher.

According to the present invention, mechanical properties of the toner can be obtained at room temperature by controlling the rheological properties of the toner. The developing properties and the fixing properties of the toner for electrophotography can be improved by lowering the viscosity at a high temperature, and thus image quality can be stabilized.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A toner for electrophotography comprising a binder resin, a colorant, a charge control agent, and a release agent, wherein the toner has a glass transition temperature (Tg) over 55° C., a molecular weight distribution (MWD) in the range of about 4.5 to 5.5 when a weight average molecular weight is in the range of about 45,000 to 55,000, and a compression elastic modulus of 750 MPa or higher at room temperature.

2. The toner of claim 1, wherein a complex viscosity (η) is in the range of about $3.5\times10^2$ to $4.5\times10^2$ Pa·s at a temperature of 10° C. lower than a toner fixing temperature.

3. The toner of claim 1, wherein a stress relaxation is in the range of about $3.5\times10^3$ to $4.0\times10^3$ Pa·s for a dwell time.

4. The toner of claim 1, wherein a loss elastic modulus (G") is in the range of about $1.5\times10^3$ to $2.5\times10^3$ Pa.

5. The toner of claim 1, wherein a critical compression strain is about 0.2 or greater.

6. A method of forming an image comprising: forming a visual image by attaching a toner to a surface of a photoreceptor on which an electrostatic latent image is formed; and transferring the visible image to a transfer medium, wherein the toner is a toner for electrophotography according to claim 1.

7. An apparatus for forming an image comprising: an organic photoreceptor; a unit charging a surface of the organic photoreceptor; a unit forming an electrostatic latent image on a surface of the organic photoreceptor; a unit containing a toner; a unit supplying the toner to the surface of the organic photoreceptor to develop the electrostatic latent image on the surface of the organic photoreceptor into a toner image; and a unit transferring the toner image from the surface of the organic photoreceptor onto a transfer medium, wherein the toner is a toner for electrophotography according to claim 1.

* * * * *